US005711326A

United States Patent [19]

Thies et al.

[11] Patent Number: 5,711,326

[45] Date of Patent: Jan. 27, 1998

[54] DISHWASHER ACCUMULATOR SOIL REMOVAL GRATING FOR A FILTER SYSTEM

[75] Inventors: Edward L. Thies, Tipp City, Ohio; Roger J. Bertsch, Stevensville, Mich.

[73] Assignee: Whirlpool Corporation, Benton Harbor, Mich.

[21] Appl. No.: 694,217

[22] Filed: Aug. 8, 1996

Related U.S. Application Data

[60] Provisional application No. 60/002,834 Aug. 25, 1995.

[51] Int. Cl.[6] ..... B08B 3/02

[52] U.S. Cl. ..... 134/104.4; 134/109; 134/111

[58] Field of Search ..... 134/104.1, 104.4, 134/111, 109, 176, 179, 56 D, 57 D, 58 D; 210/407

[56] References Cited

U.S. PATENT DOCUMENTS

| | | | |
|---|---|---|---|
| 1,256,557 | 2/1918 | Heermans | 134/111 |
| 1,583,236 | 5/1926 | Murrish . | |
| 2,287,628 | 6/1942 | McMahan | 134/104.1 |
| 2,854,141 | 9/1958 | Barnstead | 210/407 |
| 2,862,510 | 12/1958 | Geiger et al. | 134/111 |
| 3,082,779 | 3/1963 | Jacobs | 134/111 |
| 3,322,285 | 5/1967 | Lopp . | |
| 3,575,185 | 4/1971 | Barbulesco . | |
| 3,669,132 | 6/1972 | Mamrose . | |
| 3,989,054 | 11/1976 | Mercer . | |
| 4,038,103 | 7/1977 | Grunewald . | |
| 4,039,452 | 8/1977 | Fernandez . | |
| 4,150,679 | 4/1979 | Cushing et al. . | |
| 4,150,680 | 4/1979 | Johnson et al. | 134/176 |
| 4,243,431 | 1/1981 | Dingler et al. | 134/109 |
| 4,297,210 | 10/1981 | Delfosse . | |
| 4,319,599 | 3/1982 | Dingler et al. . | |
| 4,346,723 | 8/1982 | Geiger . | |
| 4,347,861 | 9/1982 | Clearman et al. . | |
| 4,392,891 | 7/1983 | Meyers . | |
| 4,559,959 | 12/1985 | Meyers . | |
| 4,673,441 | 6/1987 | Mayers . | |
| 4,971,518 | 11/1990 | Florin . | |
| 4,972,861 | 11/1990 | Milocco et al. . | |
| 5,097,855 | 3/1992 | Martinsson et al. . | |
| 5,165,433 | 11/1992 | Meyers . | |
| 5,333,631 | 8/1994 | Kirkland et al. . | |
| 5,345,957 | 9/1994 | Cooper et al. . | |
| 5,377,707 | 1/1995 | Young et al. | 134/104.4 |
| 5,623,956 | 4/1997 | Kirkland et al. | 134/104.4 |

FOREIGN PATENT DOCUMENTS

| | | |
|---|---|---|
| 1352655 | 5/1974 | United Kingdom . |

*Primary Examiner*—Frankie L. Stinson

*Attorney, Agent, or Firm*—Hill, Steadman & Simpson

[57] ABSTRACT

A soil separator for a dishwasher includes a centrifugal soil collection wall surrounded by a spill over guide channel, surrounded by a shallow annular accumulator channel. The soil accumulator channel is open to the dishwasher chamber but covered by a filter screen. An accumulator sump is arranged below the accumulator channel. The accumulator channel is partially formed by a plate or grating provided with spaced radial slots to allow soil to drop into the accumulator sump as it progresses around the accumulator channel. The shallow accumulator channel allows water to flush soil from an inside of the screen to the accumulator sump.

11 Claims, 3 Drawing Sheets

DISHWASHER ACCUMULATOR SOIL REMOVAL GRATING FOR A FILTER SYSTEM

This application claims the benefit of U.S. Provisional Application No.: 60/002,834 filed Aug. 25, 1995.

BACKGROUND OF THE INVENTION

The present invention is directed to a soil separator for a dishwasher and particularly an arrangement between a soil separator chamber and a soil accumulator chamber which provides an improved apparatus and method for collecting and filtering soil from dishwasher water.

A known arrangement for removing soil from dishwasher water is described in U.S. Pat. No. 5,165,433. This apparatus includes a combination motor-pump and soil separator assembly. The motor-pump assembly includes a wash impeller, which operates within a pump cavity located within the soil separator. As the impeller operates in a wash or rinse mode, a swirling motion is created in the wash liquid passing through the pump cavity, thereby creating a centrifugally sampled annular layer of wash liquid on the annular interior wall. A portion of the wash liquid having a high concentration of entrained soil (food particles, etc.) passes over an upper edge of the annular interior wall and into an annular guide chamber.

Wash liquid from this guide chamber travels to an annular soil collection chamber at a high flow rate. This high flow rate is achieved by use of a relatively small aperture located in a lower portion of the annular wall separating the guide chamber and the soil collection chamber. Upon entering the soil collection chamber, wash liquid flows outwardly and upwardly through a screen which separates the water from the soil. The wash liquid is prevented from draining out the soil collection chamber by a ball check valve seated within a drain port. The screen contains an annular arrangement of fine mesh filters, which prevent soil particles entrained in the wash liquid from reentering the dishwasher space. The cleansed wash liquid returns to the dishwasher floor where it is picked up by the motor driven pump for recirculation within the dishwasher.

Typically, the apparatus such as described above allows water to pass through the hole between the guide channel and the collector chamber at a rate of 4 to 5 gallons per minute. This flow rate can cause the heavily concentrated mixture of soil and water within the accumulator chamber to be agitated, preventing soils from readily settling. With this flow rate and configuration, there may be a tendency for the mechanical filter to clog even though back wash nozzles for spraying the filter from above are provided. For high flow rate soil collecting, filter screens with a 0.0049 inch mesh have had a tendency to clog. It was necessary to increase screen mesh to 0.0079 inch to prevent this clogging. However, the larger mesh screen allowed soils of larger particle size to escape through the screen and may be seen as "grit" on the dishes.

SUMMARY OF THE INVENTION

It is an object of the present invention to provide a dishwasher soil collection system which is compatible with a high flow rate soil removal dishwasher while at the same time allowing for adequate screening of soil in the dish water return to the dish compartment in a recirculating dish water system. It is an object of the invention to provide a more efficient method of soil collection and retention while reducing water and energy usage.

The objects are inventively achieved in that an annular soil separator wall is provided around the dish water pump for accumulating solids by centrifugal action, a soil guide channel is provided surrounding the soil separator wall and a shallow soil accumulator channel or "screening channel", surrounding the guide channel and substantially annular, is arranged beneath the filter screen. The soil accumulator channel is flow connected to the guide channel by a vertical tube at an inlet end of the accumulator channel. Water and soil proceed around the accumulator channel, soil is retained beneath the screen filter and water proceeds through the screen. The accumulator channel provides a plurality of slots which allows soil to fall into an accumulator sump therebelow having a drain port closed by a ball check valve. Back wash nozzles are provided to wash the screen of soil from a dish compartment side of the filter screen. Thus, by utilizing inlet water from the guide channel to the accumulator channel, the inside of the filter screen is washed while the outside of the screen is washed by the backwash nozzles above. Therefore, food particles which are temporarily dislodged from the filter screen by the backwash nozzles may not immediately return after the backwash nozzle passes due to the flow inside of the screen from the soil separator water.

Inlet water flow from the soil separator is directed in a circulatory path and kept in the shallow accumulator channel in close proximity with the screen. As particles are dislodged by the backwash nozzles, they are moved around toward the slots which deliver the soil to the stagnate soil accumulator sump below. The sump is located beneath the soil separator water inlet and therefore, more isolated and stagnate, allowing soil to settle. The slots in the accumulator channel are spaced apart to allow soil separation immediately after soil/water enters the accumulator channel and at locations around the circumference of the accumulator channel. The plurality of spaced apart slots allow the screen to stay cleaner by preventing prolonged interface with the screen.

DETAILED DESCRIPTION OF THE PREFERRED EMBODIMENTS

Figure 1:
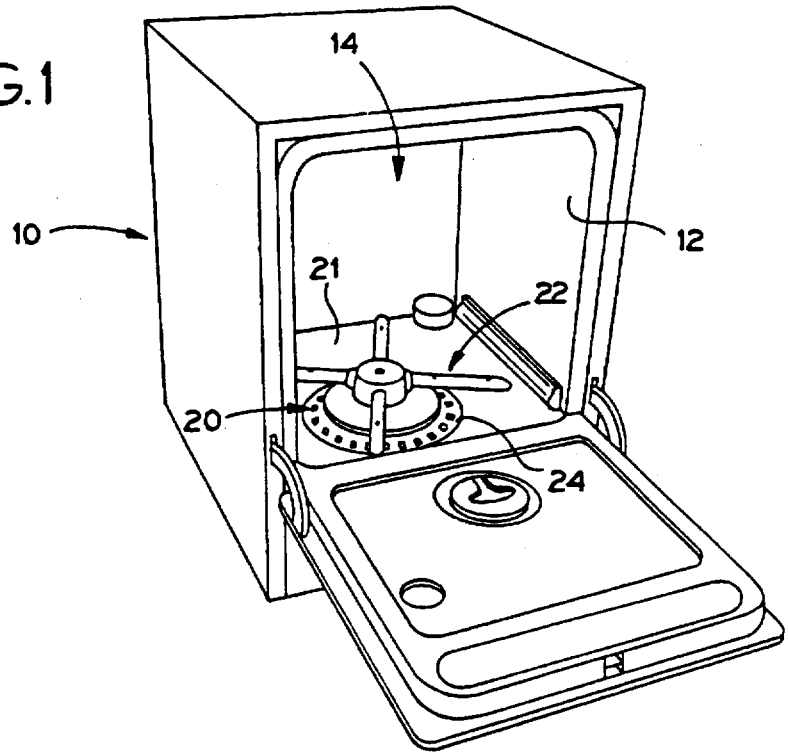
FIG. 1 is a perspective view of a dishwasher including a soil separator in accordance with the present invention.

In accordance with the invention as shown in the drawings, and particularly as shown in FIG. 1, an automatic dishwasher generally designated 10 includes an interior tank wall 12 defining a dishwashing space 14. A soil separator 20 is centrally located in floor 21 and has a lower wash arm assembly 22 extending form an upper portion thereof. Coarse particle grate 24 permits wash liquid to flow from floor 21 to soil separator 20, while preventing foreign objects, such as apricot pits and pop tops, from inadvertently entering soil separator 20.

The basic constructional features of the soil separator are explained in U.S. Pat. No. 5,165,433 herein incorporated by reference. Referring now to FIG. 3, the soil separator and pump assembly generally comprises a motor 27 having an output shaft 29 secured to base plate 30 by bolts 32. The motor 27 is a reversing motor which normally operates in a clockwise direction, as viewed in FIG. 2. When operated in a clockwise direction, such as in a wash mode or a rinse mode, the motor 27 provides a pumping action within soil separator 20, thereby providing pressurized wash liquid to lower wash arm assembly 22.

As shown in FIG. 3, lower wash arm assembly 22 includes a central hub 33 having a plurality of wash arms 35 extending radially therefrom. Each wash arm 35 includes one or more upwardly directed spray nozzles 38 for directing wash liquid upwardly within dishwashing space 14, and one downwardly directed spray nozzle 40 for providing a back-washing action, as will become apparent. Liquid passageway 42 in central hub 33 permits pressurized wash liquid to flow to the lower wash arm assembly 22.

Figure 2:
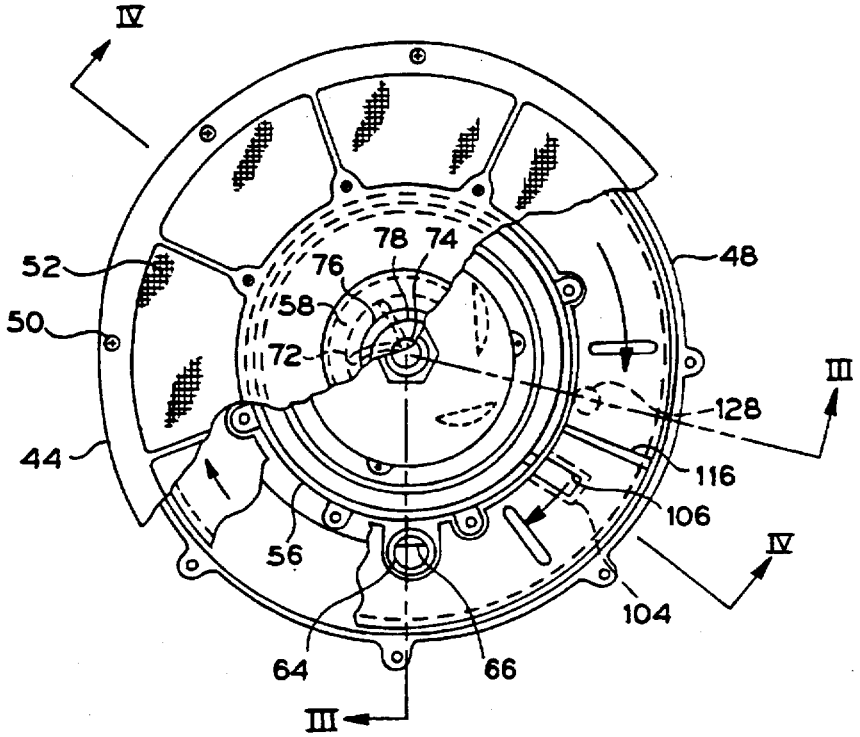
FIG. 2 is a plan view of the soil separator having the wash arm assembly removed therefrom and with a portion of the soil separator screen cut away.
Figure 3:
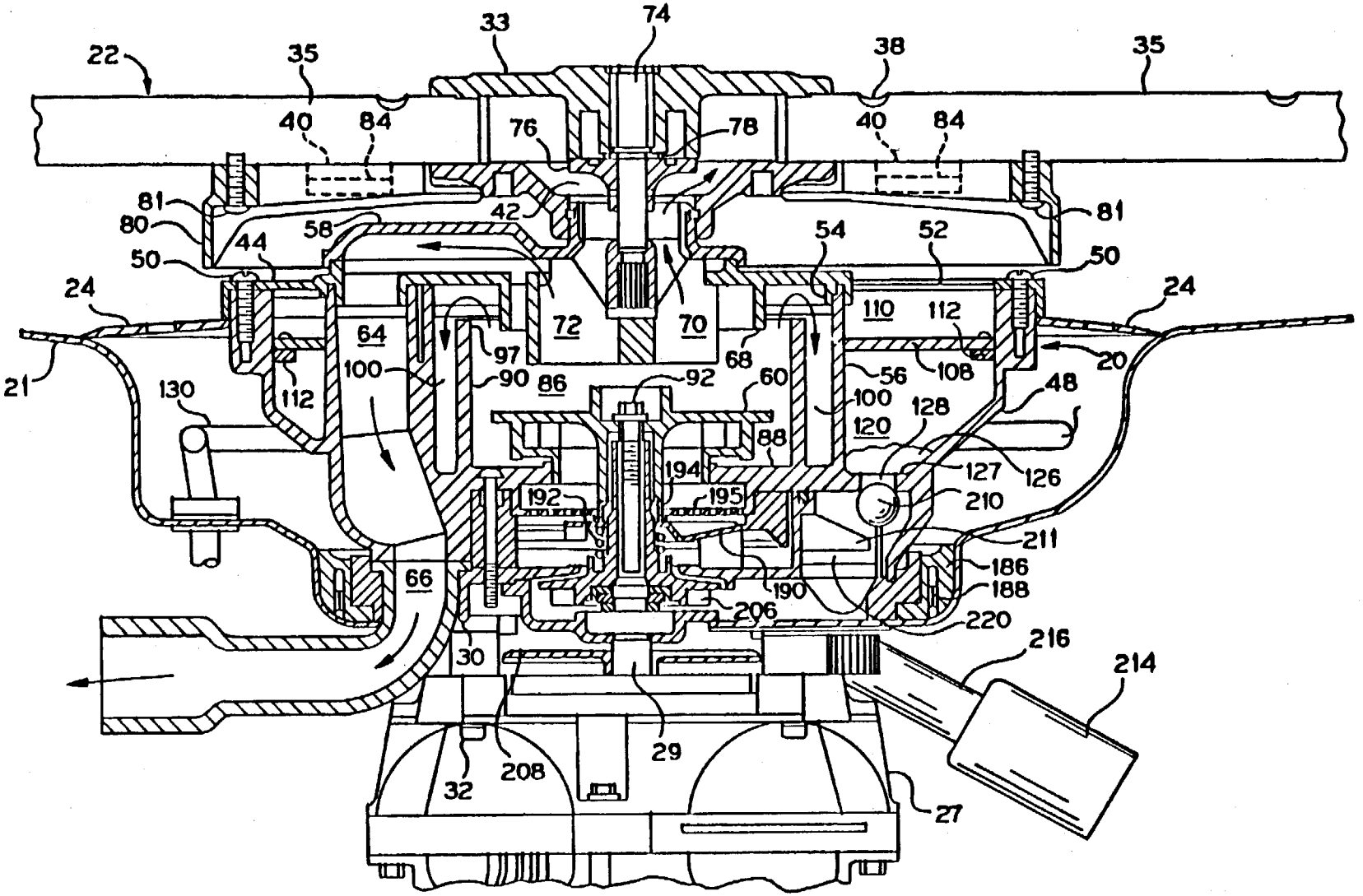
FIG. 3 is a diametric section of the soil separator including the wash arm assembly taken generally along line III—III of FIG. 2.

As shown in FIG. 2, the soil separator 20 further includes an annular cover 44 which is disposed over and secured to soil container wall 48 by screws 50. When in place, cover 44 and soil container wall 48 combine to form a low-pressure water seal, preventing leakage of water therebetween. Cover 44 includes a series of fine mesh filter segments 52 which are radially disposed about a central axis of the cover. Fine mesh filter segments 52 are preferably formed of a synthetic material such as nylon or polyester and have a mesh on the order of 0.0049" to 0.0106". Depending on the material desired to be filtered, however, a larger or smaller mesh filter may be used.

Referring back to FIG. 3, located radially inwardly from the fine mesh filter segments 52 and depending downwardly from cover 44 is an annular lip 54. Annular lip 54 forms a high-pressure seal in combination with an upstanding annular wall 56, as will become apparent. An upper wash arm feed channel 58 is disposed on top of cover 44, providing a continuous flow path for transporting pressurized wash liquid from the impeller 60, through upper wash arm feed tube 64, downwardly to conduit 66 and to the upper wash arm (not shown).

Further located radially inwardly from the annular lip 54 of the cover 44 is a downwardly depending annular wall 68. Annular wall 68 defines a centrally located interior area containing a plurality of vanes for directing pressurized wash liquid. Lower wash arm feed vanes 70 direct a first portion of the pressurized wash liquid through liquid passageway 42 to wash arms 35. Corresponding upper wash arm feed vanes 72 direct a second portion of the pressurized wash liquid to upper wash arm feed channel 58. Extending upwardly at the central axis of the cover is a fixed spindle 74.

Bushing 76 is mounted on spindle 74 by any appropriate conventional means, such as a drift pin. Washer 78 is supported by bushing 76, providing a low-friction support for lower wash arm assembly 22.

Referring to FIG. 3, it may be seen that lower wash arm assembly 22 is freely rotatably mounted about its central axis on spindle 74. A filter guard 80 is mounted to wash arms 35 by screws 81. Filter guard 80 overlies the fine mesh filter segments 52 of cover 44, protecting fine mesh filter segments 52 from damage caused by falling utensils or tableware. In operation, pressurized wash liquid flows past bushing 76 into wash arms 35. Upwardly directed nozzles 38 are positioned on wash arms 35 so as to provide a chordally directed thrust, causing lower wash arm assembly 22 to rotate about spindle 74 when pressurized wash liquid is pumped through nozzles 38.

As lower wash arm assembly 22 rotates, pressurized wash liquid is emitted from downwardly directed nozzles 40. A deflector tab 84 integrally formed as part of filter guard 80 is disposed directly beneath each nozzle 40, impinging on the flow of wash liquid emitted therefrom. As the flow of water from each nozzle 40 strikes the associated deflector tab 84, a fan-shaped spray is formed. Each fan-shaped spray sweeps the top of the fine mesh filter segments 52 as lower wash arm assembly 22 rotates, thereby providing a back-washing action to keep fine mesh filter segments 52 clear of soil particles which may impede the flow of cleansed wash liquid into dishwashing space 14.

The wash impeller 60 is located within pump cavity 86. Pump cavity 86 is generally defined by the soil separator lower housing wall 88, an inside upstanding annular wall 90, and cover 44.

Wash impeller 60 is secured to the output shaft 29 of pump motor 27 by impeller retaining bolt 92, and pumps wash liquid when in operation. The majority of the pressurized wash liquid enters the area beneath the cover 44 defined by downwardly depending annular wall 68, and is divided and directed by lower wash arm feed vanes 70 and upper wash arm feed vanes 72. Under normal operating conditions, flow of pressurized wash liquid is provided to the lower wash arm and to the upper wash arm.

During normal operation, a third portion of the wash liquid is maintained within the soil separator to be cleansed and returned to circulation. In pump cavity 86, a portion of the wash liquid having a high concentration of entrained soil tends to accumulate on the inside upstanding annular wall 90. The swirling motion of the liquid tends to carry the soil upwardly over the upper edge 97 of wall 90, whereupon the soil-laden liquid collects within annular guide chamber 100 defined between the inside upstanding annular wall 90 and outside upstanding annular wall 56. Undesirable pressure loss within the annular guide chamber 100 is prevented by forming a relatively water-tight, high pressure seal at the juncture of cover 44 and outside upstanding annular wall 56.

Figure 4:
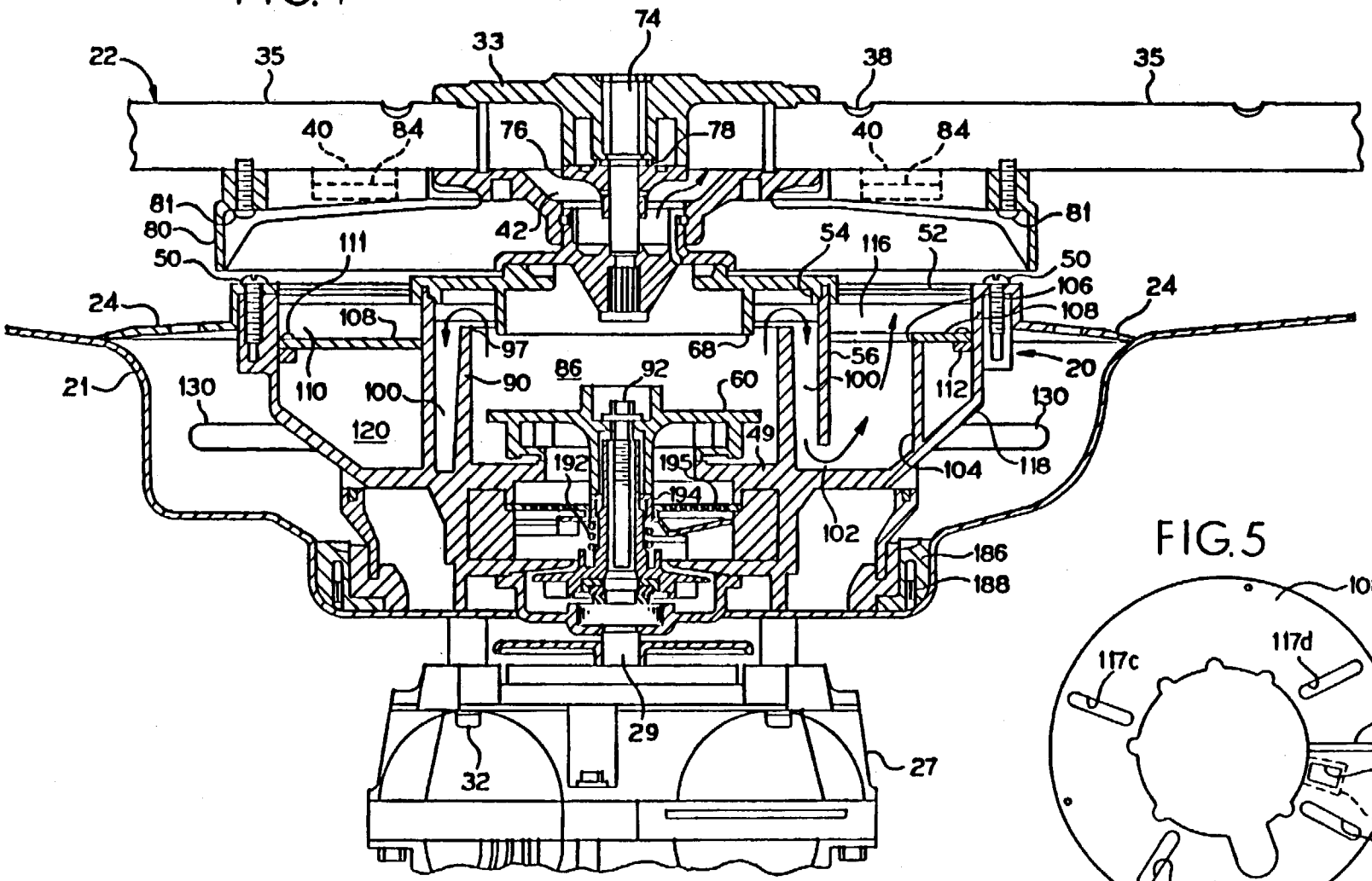
FIG. 4 is a sectional view of the soil separator taken generally along line IV—IV of FIG. 2.

As shown in FIG. 4, soil laden water flows through an inlet 102 into a tube 104 and upward through a hole 106 formed through a substantially annular plate or "grating" 108. The plate 108 forms a shallow soil accumulator channel 110 or "screening channel" beneath the screen segments 52. The plate 108 can be attached by screws 111 to a ledge 112 formed from the wall 48.

Figure 5:
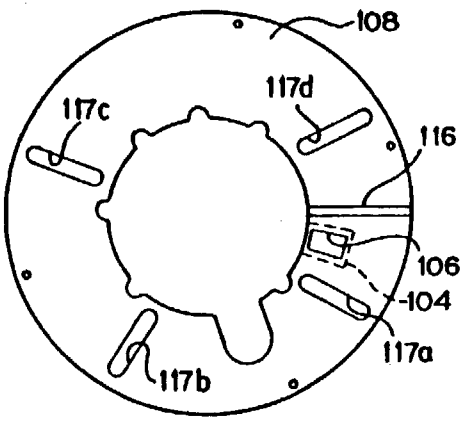
FIG. 5 is a plan view of an accumulator chamber disc.

As shown in FIGS. 2, 4 and 5, the plate 108 has a divider plate 116 extending upwardly therefrom to the screen segments 52. A plurality of slots 117*a, b, c, d* are provided through the annular plate 108. In operation the soil laden water proceeds through the hole 106 above the plate 108 and proceeds in a clockwise direction in FIGS. 2 and 5. Water passes upwardly through the screen 52 and the soil proceeds along the annular plate 108 and through the slots 117*a, b, c, d* and into the accumulator sump 120. As the water proceeds around the plate 108 its velocity slows and soil settles out onto the annular plate 108 and moves through the slots 117*a, b, c, d* and into the sump 120.

By maintaining a shallow accumulator channel 110 between the plate 108 and the screen segments 52, from the tube 104 to the sump 120, any clogging of the screen segments 52 on an inside thereof can be effectively alleviated. When the backwash nozzle 40 passes, soil is back washed away from the screen, and water passing within the channel 110 moves the soil around the annular plate, through the slots and into the sump 120 and prevents repositioning of the soil against the screen segments 52.

Fine mesh filter segments 52 in cover 44 permit flow of cleansed wash liquid to return to dishwasher space 14 for recirculation. Light soil particles are screened by fine mesh filter segments 52 and deposited in soil accumulator sump 120. Accordingly, both heavy and light soil particles remain within the soil accumulator sump 120.

FIG. 3 illustrates that the sump 120 is defined by walls 56, 48 and a floor 127, and side walls 122, 124. Soil 126 is collected within the sump 120 on the floor 127 and expelled during the drain cycle through the drain port 128.

When operated in a wash or rinse mode, the dishwasher functions as a continuous fluid circuit. In a wash mode, for example, wash liquid flows from dishwashing space 14 to dishwasher floor 21 and is gravity-fed to coarse particle grate 24. Wash liquid flows past heating unit 130 to soil separator 20, where it is drawn inwardly by negative pressure created by impeller 60. Wash liquid flows over sealing ring 186, which, in combination with floor 21 and retainer ring 188, serve to support and seal the soil separator and pump assembly within the dishwasher. Wash liquid continues to flow horizontally and inwardly over base plate 30, until encountering soft soil chopper 190.

As may best be observed in FIG. 3, soft soil chopper 190 is located on motor shaft 29 and rotates therewith to macerate large soft soil particles which travel past grate 24. Torsion spring 192 both supports and drives chopper 190, urging chopper 190 upwardly against collar 194, which in turn is held in place on output shaft 29 by a downwardly depending shoulder of wash impeller 60.

After passing soft soil chopper 190, wash liquid is drawn through grate 195 and further upwardly into pump cavity 86 by wash impeller 60. Wash impeller 60 imparts a swirling motion to the wash liquid, forcing a majority of the wash liquid upwardly to lower wash arm feed vanes 70 and upper wash arm feed vanes 72. Wash liquid sprayed from upwardly directed spray nozzles 38, downwardly directed spray nozzles 40 and cleansed wash liquid emitted from fine mesh filter segments 52 into dishwashing space 14 returns to floor 21 to be recycled.

Due to centrifugal force acting on the swirling liquid in pump cavity 86, the remainder of the wash liquid forms a band or layer on the interior of first upstanding annular wall 90. This band of wash liquid contains a heavy concentration of entrained soil particles having a relatively high specific gravity, which tend to be forced outwardly by centrifugal force. This band of wash liquid also contains approximately the same concentration of soil particles having a relatively low specific gravity representative as the wash liquid as a whole.

As soil-laden wash liquid flows around soil accumulator channel 110, its velocity is reduced, permitting heavy soil particles to collect in sump 120 on lower housing wall 127. As the clockwise rotation of wash impeller 60 forces soil-laden wash liquid into soil accumulator channel 110, clockwise rotation of drain impeller 206, as shown in FIG. 5, causes a clockwise flow of wash liquid within drain pump chamber 208.

Pressure created by wash liquid flow within drain pump chamber 208 causes ball check valve 210 to rise from a resting position on ball check valve support 211 to a seated position on the bottom side of soil container drain port 128, as shown in FIG. 3. When so positioned, ball check valve 210 prevents flow of accumulated soil particles and wash liquid therethrough. Check valve 214 located in line with and downstream of a drain port (not shown) and prevents air from entering the drain port during operation of drain impeller 206 in a clockwise direction.

Upon completion of a wash or a rinse cycle, a drain cycle is initiated. At that time, pump motor 27 is reversed, causing drain impeller 206 to rotate in a counter-clockwise direction, as viewed in FIG. 2. Drain impeller 206 causes negative pressure to be applied within conduit 220, which causes ball check valve 21 0 to fall away from soil container drain port 128. Soil-laden water and accumulated soil within soil accumulator sump 120 is rapidly pumped out by drain impeller 206, and expelled through drain port 216. In addition, drain impeller 206 is further in fluid connection with floor 21. Wash or rinse liquid draining from soil separator 20 accumulates on base plate 30, and is pumped out through drain port 216 along with liquid from floor 21. Accordingly, when operated in a counterclockwise direction, drain impeller 206 rapidly and effectively drains soil separator 20.

Alternate developments of the invention provide for screen segments 52 to have a fine screening region of approximately 180° around the channel 118 and a coarse screening region around approximately 180° around the channel. The fine screening region is provided with a back pressure control to divert soil laden water to the coarse screening region if the fine screening region becomes too clogged. Therefore, the water is fine screened if at all possible before the diversion to coarse screening, without the need to bypass the screening entirely. Both the fine screening region and the coarse screening region can be provided with a single opening into a sump located at one end of the respective regions.

Additionally it is encompassed by the invention that the inside wall 90 can be eliminated, the tube 104 can be eliminated, and the opening 102 can be located through the wall 56 at an elevated position to allow soil laden water to pass horizontally, directly into the channel 110.

Although the present invention has been described with reference to a specific embodiment, those of skill in the art will recognize that changes may be made thereto without departing from the scope and spirit of the invention as set forth in the appended claims.

The embodiments of the invention in which an exclusive property or privilege is claimed are defined as follows:

1. A soil separator for a dishwasher comprising:

a cylindrical wall;

a water impeller arranged for rotation within said cylindrical wall;

a shallow arcuate channel covered by a screen and flow connected to an area within the cylindrical wall;

a soil accumulation area for collecting soil from the water arranged below said arcuate channel; and said arcuate channel having a plurality of slots arranged to pass soil downwardly into said soil accumulation area.

2. The soil separator according to claim 1, further comprising a guide channel surrounding said cylindrical wall between said cylindrical wall and said shallow arcuate channel, said cylindrical wall comprising a height providing a spill over into said guide channel; and an inlet tube from said guide channel into said shallow arcuate channel.

3. The soil separator according to claim 2, wherein said shallow arcuate channel comprises an annular horizontal plate surrounding said guide channel elevated from a bottom of said guide channel, and said screen comprises a substantially annular horizontal screen arranged above said plate.

4. The soil separator according to claim 2, wherein said guide channel comprises an outer wall surrounding said cylindrical wall with an aperture flow connected to said inlet tube.

5. A centrifugal soil separator, comprising:

a rotating element;

a surrounding wall;

an outlet water conduit receiving water flow from said rotating element;

a soil/water flow channel receiving water with entrained soil from adjacent said surrounding wall;

a soil screening channel having a screen element on a top side thereof for passing water therethrough while retaining soil below, and a plate on a bottom side thereof, said screening channel surrounding said surrounding wall, said soil/water flow channel flow connected to said screening channel;

a soil accumulator sump flow connected to said screening channel by a plurality of radial slots spaced around said plate; and means for draining soil from said accumulator sump.

6. The soil separator according to claim 5, wherein said soil/water flow channel comprises an outer wall surrounding said surrounding wall and an open top annular gap provided between said surrounding and outer walls, and a vertical tube connecting said annular gap and said screening channel.

7. The soil separator according to claim 6, wherein said means for draining comprises a drain port closed by a ball check valve.

8. A dishwasher soil separator comprising:

a rotating wash impeller;

a circular surrounding wall;

an outlet water conduit receiving water flow from said rotating impellera soil/water flow channel receiving water with entrained soil from adjacent said surrounding wall;

an annular soil screening channel having an annular plate with a soil/water inlet region having an end wall, and having a screen element on a top side thereof for passing water therethrough while retaining soil below said element, said screening channel surrounding said surrounding wall, said soil/water flow channel flow connected to said inlet region of said screening channel; and an annular soil accumulator sump arranged below said annular plate and flow connected to said screening channel at a plurality of locations around said annular screening channel; and means for draining soil from said accumulator sump.

9. The soil separator according to claim 8, wherein said soil/water flow channel comprises an outer wall surrounding said surrounding wall forming a guide channel therebetween, and a spill over water path provided between said surrounding and outer walls, and a vertical tube connecting said guide channel and said screening channel.

10. The soil separator according to claim 9, wherein said annular plate has an aperture connected to said vertical tube, and said accumulator sump is flow connected to said screening channel by a plurality of spaced apart radial slots.

11. The soil separator according to claim 10, wherein said means for draining comprises a drain port closed by a ball check valve.

* * * * *